US006065851A

United States Patent [19]

So

[11] Patent Number: 6,065,851

[45] Date of Patent: May 23, 2000

[54] MODIFIED SPRING SWITCH AND LIGHT MODULE THEREFOR

[75] Inventor: Kwok Kwong So, Apleichau, The Hong Kong Special Administrative Region of the People's Republic of China

[73] Assignee: Saihon Enterprise Co., Ltd., Causeway Bay, The Hong Kong Special Administrative Region of the People's Republic of China

[21] Appl. No.: 09/018,361

[22] Filed: Feb. 4, 1998

[51] Int. Cl.[7] ..... F21V 23/04; H01H 35/02

[52] U.S. Cl. ..... 362/103; 362/251; 362/276; 362/802; 200/61.49

[58] Field of Search ..... 362/103, 276, 362/800, 802, 251; 200/61.45 R, 61.48, 61.49, 61.5, 61.51; 36/137

[56] References Cited

U.S. PATENT DOCUMENTS

| | | | |
|---|---|---|---|
| 3,052,949 | 9/1962 | Johnson | 200/61.51 |
| 3,731,022 | 5/1973 | Loftus | 200/61.51 |
| 4,311,891 | 1/1982 | Faust | 200/61.45 R |
| 5,408,764 | 4/1995 | Wut | 36/137 |
| 5,419,061 | 5/1995 | Barrocas | 36/137 |
| 5,477,435 | 12/1995 | Rapisarda et al. | 362/189 |
| 5,550,721 | 8/1996 | Rapisarda | 362/205 |
| 5,599,088 | 2/1997 | Chien | 362/103 |
| 5,644,858 | 7/1997 | Bemis | 36/137 |
| 5,789,716 | 8/1998 | Wang | 200/61.45 R |
| 5,866,987 | 2/1999 | Wut | 362/103 |
| 5,894,201 | 4/1999 | Wong | 362/103 |

*Primary Examiner*—Alan Cariaso
*Attorney, Agent, or Firm*—Darby & Darby

[57] ABSTRACT

Flashing footwear includes at least one light source located on an external surface of the footwear so as to be visible. A power source provides sufficient power to illuminate the light in response to a change in the conductive state of a spring switch. A circuit is combined with the battery and switch to form a module arranged in the heel of the footwear. The switch is comprised of an electrically conducting coil spring which is fixed at one point and is free at one end. The free end is cantilevered over a substrate and includes a non-conducting weight. An electrically conducting contact arch is positioned on the substrate beneath the spring and between the fixed point and the free end, and extends towards the coil spring. The fixed point of the spring and the contact are connected to the remainder of the lighting circuit. When a sufficient force is exerted on the spring, the spring touches the contact, thus closing the switch.

19 Claims, 5 Drawing Sheets

MODIFIED SPRING SWITCH AND LIGHT MODULE THEREFOR

BACKGROUND OF THE INVENTION

The present invention relates to lighted footwear and, more particularly, to footwear with light modules that apply power from a power source in such a way as to turn on the lights so the safety of the wearer is improved, the useful life of the power source is extended and an attractive lighting pattern is created.

At various times in the past, lighted footwear has enjoyed some popularity. This lighted footwear all has the same basic components, i.e., at least one light source, a source of power for the light or lights, and a switch of some sort to apply the output of the power source to the light to cause it to come on and provide illumination. The lights can be of a variety of types, e.g., incandescent bulbs, electro-luminescent panels, and light emitting diodes (LEDs). These are popular lights for this purpose because they can be lighted by the power from small batteries, so that the elements lighting the light can be encapsulated in the footwear and need not be connected to any external power source. However, there is no reason that light sources which require a.c. voltage or current, such as fluorescent lights, could not be used in lighted footwear, assuming a suitable power source were provided. Consequently, as used in this application, "light source" is intended to encompass any device capable of generating detectible light, visible or otherwise, e.g., infrared.

In its simplest form, lighted footwear typically has lights in the heel and along the sole of the footwear, which could be athletic shoes, casual shoes, formal shoes or sandals for men, women or children. A battery, e.g, of three (3) volts output, is incorporated in the heel or sole of the shoe and is connected by wires to the lights. A switch is provided in the connecting wires to control the illumination of the lights, which switch may be a simple manual switch as disclosed in U.S. Pat. No. 4,158,922 of Dana, III. Thus, whenever the user wishes the lights to be on, for example, just before he or she goes jogging at night, he or she can turn on the lights by operating the switch. However, with such an arrangement the lights would be on continuously until the switch is turned off.

If the lights are flashed intermittently, there are two advantages. First, the life of the battery is increased in proportion to the time the lights are off during the intermittent flashing. Second, a more attractive eye-catching display is provided. When running at night, the flashing of the lights makes the user more visible, e.g., to motorist, so that the safety of the user is increased. One way to achieve a flashing effect is to utilize a motion-activated switch to apply power to the lights. This could be a mercury switch which is in the form of a tube containing a quantity of mercury and having spaced-apart electrical contacts. The tube is oriented on the footwear so that when the footwear is flat, there is no connection between the contacts. However, as the footwear is tilted, as during the taking of a step, the mercury runs down the tube and closes the contacts. This contact is broken again when the footwear is flat again at the completion of the step. Thus, as the user walks, the lights come on and go off. Mercury switch operated lighted footwear is disclosed in U.S. Pat. No. 4,848,009 of Rodgers and the Dana III '922 patent mentioned above.

In another form of motion-activated switch, the mercury in a mercury switch is replaced for environmental reasons with a metal ball that rolls in the tube. Further, mechanical motion activation can be achieved by the mechanical lever system disclosed in U.S. Pat. No. 2,572,760 of Rikelman. In addition, intermittent operation of the lights can be achieved by a pressure switch. During jogging, whenever the wearer's foot hits the ground the pressure activates a switch in the shoe which closes the circuit and causes the lights to flash. Such a pressure switch is disclosed in European Patent Application No. 0 121 026 of Dana III.

Another way to achieve an intermittent lighting effect is to incorporate an electronic circuit into the flashing footwear. This circuit could be an integrated circuit low frequency oscillator or flasher operated by the switch and providing the power to the lights. Whenever the switch is closed the oscillator provides power to the lights at a slow rate, e.g., from 0.5 to 2.5 Hz. Such a flasher could be like the National Semiconductor LM3909 LED Flasher/Oscillator. Use of this device to provide intermittent lighting is disclosed in the Dana III European patent application. The U.S. Pat. No. 4,158,922 of Dana III also discloses a low frequency oscillator made from individual components which is used in this fashion.

One problem with these prior motion-activated switches, e.g., the mercury, ball, lever and pressure switches, is that they can remain continuously closed, thus allowing the lights to stay on and running the battery down. For example, if shoes with the mercury, ball or lever switches are placed at an attitude corresponding to a step in walking, the switch will close and the lights will light continuously. With the pressure switch, if the wearer is merely standing in one place for too long, the lights will remain on and premature exhaustion of the battery will occur. Similarly, the shoes with the pressure switch can be packed so there is enough pressure on the switch that these lights are on. If shoes with any of these switches are in transit from the factory to the store shelves at an attitude or under sufficient pressure to cause the lights to be on, the flashing effect may no longer work at the time an attempt is made to sell the product to the ultimate user or soon after the sale. This can cause customer complaints and returns of the merchandise.

An electronic solution to the problem of premature battery exhaustion is disclosed in U.S. Pat. No. 4,848,009 of Rodgers. The Rodgers patent proposes that the power to light the lights be provided from the battery through a circuit. This circuit is than controlled by the switch and a further timing circuit so that when the switch closes the circuit provides power to the light and starts the timing circuit. After a predetermined period of time the timing circuit signals the power circuit to cut off the power to the lights. Power cannot be reapplied to the lights until the switch opens and closes again. This results in a single illumination of the lights for a fixed period of time in response to the closure of the switch.

An alternative arrangement for avoiding premature battery exhaustion is provided in U.S. Pat. No. 5,408,764 of Wut. The Wut arrangement uses a battery, lights and a spring switch. The spring switch is in the form of a coil of spring wire which is cantilevered over an electrical contact on a printed circuit board. The other end of the spring is also connected to an electrical contact. Whenever a sufficiently large jolt is given to the switch, a module containing the switch, or a shoe containing the switch, the coil of wire will swing until the end portion of the coil comes into contact with the printed circuit board contact, thus closing the circuit and supplying power to light the lights. Wut teaches placing plastic weight on top of the spring to enhance its downward motion.

Once the end of the spring in the Wut switch comes into contact with the printed circuit board, its momentum is transferred to the rest of the assembly and the spring nature of the coil causes it to recoil from the printed circuit board, thus breaking the contact. A spring switch arrangement of this type provides only intermittent contact, so it cannot apply power to the lights for a long period of time and run down the battery. However, the contact period is very short and subject to bounce or jitter, since the motion of the spring (and that of the weight if attached) is interrupted the instant contact is made. Thus, it would be beneficial to provide a spring switch mechanism for lighted footwear which provides a more reliable and longer duration of contact.

A variation of the spring switch used for lighting LEDs is disclosed in U.S. Pat. No. 5,550,721 to Rapisarda. The Rapisarda '721 patent teaches forming a spring switch by placing a coiled spring around one of the leads of the LED and positioning the spring inside a hollow portion of a conductor mounted on one terminal of the battery. The other LED lead is connected to the opposite battery terminal. When force is applied to the assembly, the spring makes intermittent contact with the mounted conductor, closing the circuit and causing the LED to light. Rapisarda '721 discloses that a blinking lighting effect can be obtained by cantilevering the spring beyond its supporting LED lead and the conductor, in order to allow the spring to oscillate and make repeated contact with the conductor for a period of time after force is applied. The sensitivity of the switch and the duration of the blinking effect can be adjusted by changing the length of the spring extending beyond the contact point. However, this arrangement is only suitable for lighting a single LED since the LED, battery, and switch are physically integrated with each other and no room is provided to add a separate switching circuit. In addition, because one terminal of the switch (the LED lead) is completely encompassed by the other terminal (the spring), there is little tolerance for component variations introduced during manufacturing and assembly.

U.S. Pat. No. 5,644,858 to Bemis discloses another variation of an oscillating spring switch. One terminal of the switch is formed by a coil spring fixed at one end and having a conductive weight, such as a steel ball, affixed to the other end. The second switch terminal is formed of a conductive surface arranged around the weight. When force is exerted on the switch, the spring-weight system oscillates and the weight makes repeated contact with the opposing conductive surface and causes the light to blink. However, as with the Wut switch, the motion of the spring is interrupted at the moment the weight makes contact with the opposing conductor and closes the switch. Thus, the period of contact is very short and subject to bounce or jitter. Furthermore, the flashing display produced by the Bemis module is limited to the brief interval during which the spring continues to oscillate.

In U.S. Pat. No. 5,477,435 to Rapisarda et al., a spring switch is formed by connecting one lead of an LED directly to a battery terminal and cantilevering the other LED over the opposite battery terminal. When the assembly is jarred sufficiently, the cantilevered LED lead makes contact with the battery and causes the LED to briefly light. A weight is placed on top of cantilevered lead to increase the inertia of the lead. As in the Rapisarda '721 patent, this assembly is only suitable for lighting a single LED since the LED and battery are physically integrated with each other to form the switch assembly and no room is provided to add a separate switching circuit.

U.S. Pat. No. 5,419,016 to Barrocas discloses a lighting module which utilizes a spring switch similar to that disclosed in the Rapisarda '721 patent. The switch is formed by a coil spring with a free end, which has a straight wire running through its center. When sufficient force is exerted on the spring, the free end makes intermittent contact with the straight wire, thus closing the switch. However, as in the Rapisarda '721 patent, one terminal of the switch is completely encompassed by the other terminal. Thus, there is little tolerance for component variations introduced during manufacturing and assembly.

It is known to provide enhanced attractiveness to flashing footwear by providing sequential lighting of a plurality of lights, instead of mere intermittent lighting. Thus, for example, if there were three lights on the shoe, each switch closure would cause them to light in sequence, as opposed to simultaneously, and the sequence could be repeated two or more times.

The Rodgers and Wut patent designs provide single illuminations of the lights when the foot hits the ground during walking or jogging. The Rapisarda '721 and Bemis designs allows lighting to occur for a small period of time after the initial illumination. However, the time period is limited to the duration of the spring oscillation and, like in the Rapisarda '435 patent, the design only provides for a simple on-off sequence for a single LED. The Barrocas design provides for multiple lights but, like the design in the Rapisarda '721 patent, requires precision assembly of the switch. Thus, it would also be beneficial to have lighted footwear that could provide coordinated and possibly extended lighting of one or more LEDs in a unique and novel sequence, but still avoid the problem of premature battery exhaustion by utilizing an easy to assemble switching assembly.

SUMMARY OF THE INVENTION

The present invention is directed to lighted footwear in which the lights are actuated by an improved switching mechanism that is responsive to inertial forces acting on the footwear. The improved switching mechanism comprises an electrically conducting coil spring which is fixed at one end, free at the other and cantilevered over a substrate, such as printed circuit board. The free end of the coil spring has a non-conducting weight attached to it. An electrical contact is positioned on the substrate beneath the coil spring and between the fixed and free ends. The fixed end of the spring and the contact are connected to the remainder of the lighting circuit. The switch assembly may be placed in a protective housing and the entire lighting circuit encapsulated in a weather resistant plastic housing secured in the heel or sole of the shoe. Wires extend from the module to connect it to light sources, e.g., LEDs located on visible portions of the shoe, such as the heel and sides, or the light sources can be integral with the module.

When a downward force is exerted on the coil spring, it touches the contact, closing the circuit and activating the lighting sequence. Due to the inertia of the spring, which is enhanced by the non-conducting weight at the free end of the spring, the portion of the spring extending beyond the arch continues to move downward, maintaining the connection between the spring and the contact for an additional period of time. The non-conducting weight at the free end of the coil spring not only increases the inertia of the coil spring, but also the sensitivity of the switch to motion.

In one embodiment, the switch is used to activate one or more LEDs directly. In an alternate embodiment, the switch is used to activate an electronic sequencer or flasher to sequence or flash the lights in a predefined or random pattern while the switch remains closed. Alternatively, a switching circuit may be provided to drive the lighting circuitry for a period of time based on the operation of the switch.

BRIEF DESCRIPTION OF THE DRAWINGS

The foregoing and other features of the present invention will be more readily apparent from the following detailed description and drawings of illustrative embodiments of the invention in which.

DESCRIPTION OF ILLUSTRATIVE EXEMPLARY EMBODIMENTS

Figure 1:
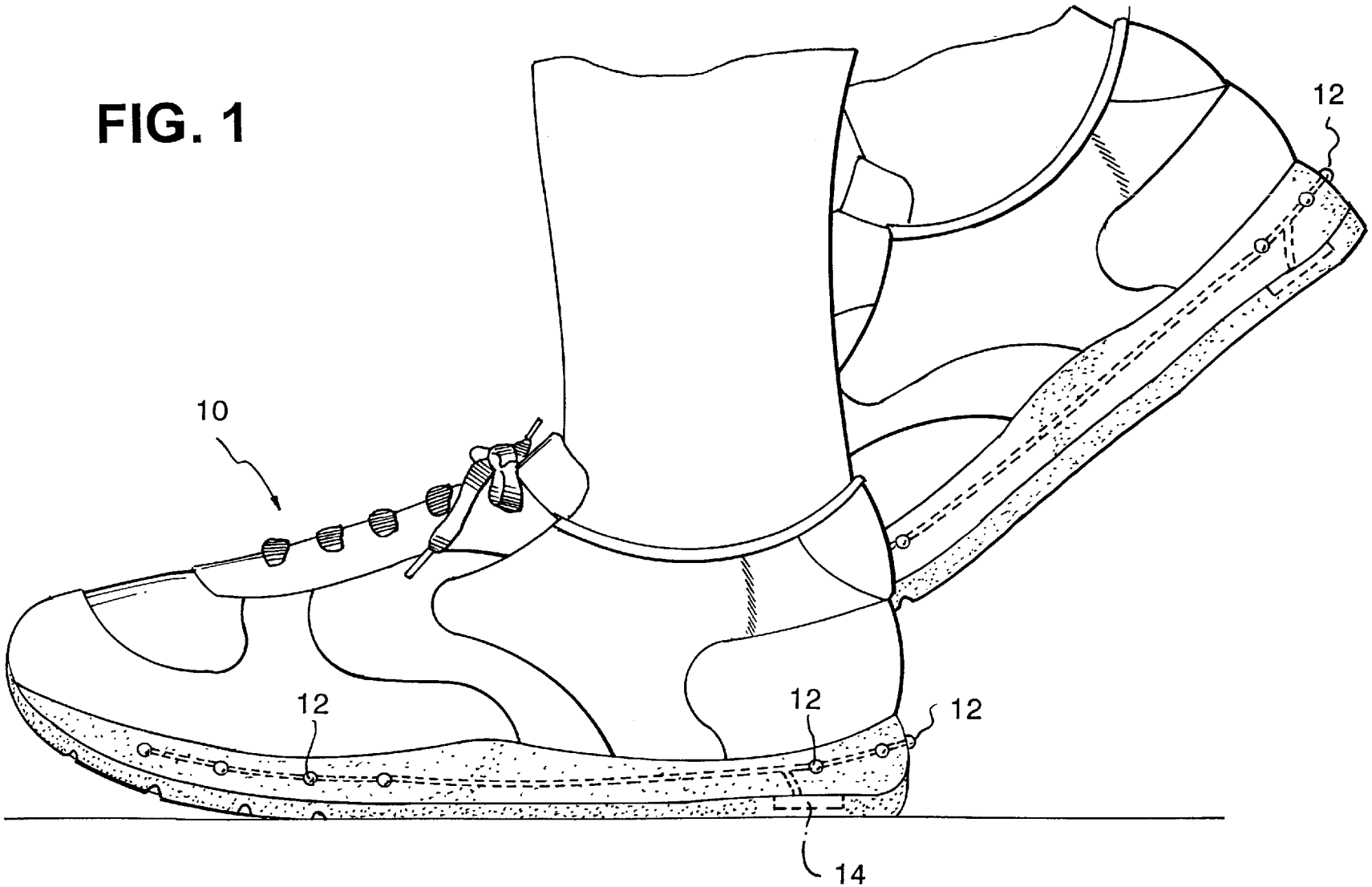
FIG. 1 shows the feet of a person walking or jogging in footwear incorporating the flashing light system of the present invention.

FIG. 1 shows a pair of athletic shoes 10 on the feet of a person walking or jogging. While athletic shoes are shown, it should be understood than any type of shoe may incorporate the present invention, such as women's high heels, men's dress shoes, boots, slippers, etc. These shoes are equipped with one or more light sources 12, such as light emitting diodes (LEDs). However, the lights 12 could be any other type of light source or a mixture of several types of lights including incandescent, electro-luminescent, infrared or ultraviolet.

The lights receive power and are turned on by a module 14 which may be embedded in the heel of the shoes as shown in FIG. 1. Alternatively, the module 14 may be located in the sole or upper of the shoe or removably affixed to the shoe or leg, e.g., by a VELCRO™ strap which contains the light sources 12. The module will typically contain at least a power source, e.g., a battery, and a switch for controlling the lighting of the lights. To achieve this, wires extend from the module to each of the lights and provide lighting power to them from a battery in the module. The module may also contain additional circuitry to control the lights in response to the switch.

Figure 2:
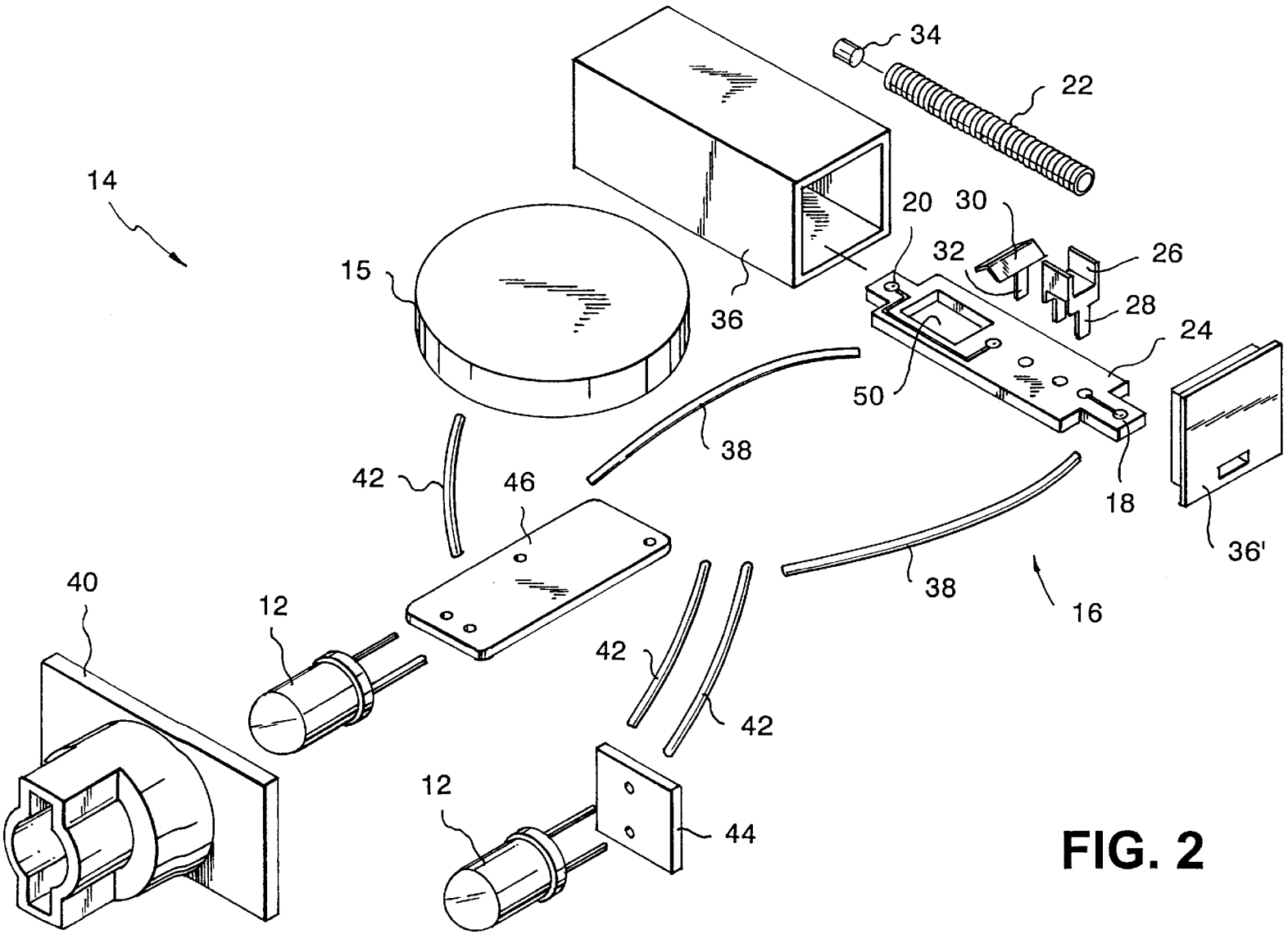
FIG. 2 is an exploded perspective view of a circuit for driving lighted footwear according to an illustrative embodiment of the present invention.
Figure 3:
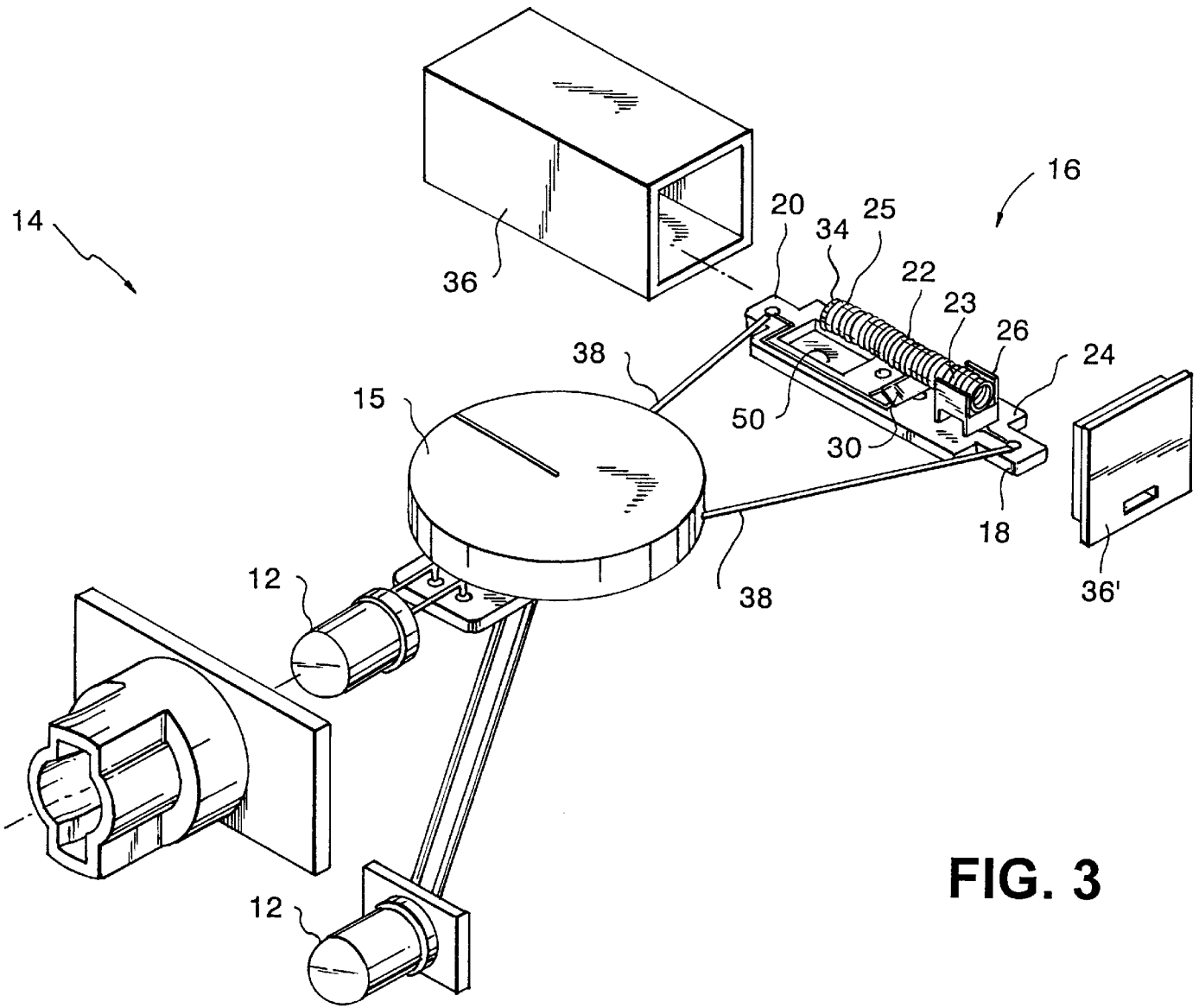
FIG. 3 shows the exploded perspective view of FIG. 2 in a partially assembled state.

One embodiment of the improved light module 14 according to the invention is illustrated in FIGS. 2 and 3. The light module includes a battery 15 and a switch assembly 16 and drives one or more light sources, i.e., LEDs, 12. A round watch battery 15 is shown, but cylindrical or other small batteries could be used.

Once assembled, the module 14 can be encased in a hard plastic material to protect it from pressure, moisture, and other types of damage. It is understood that the light sources 12 can be integrated into an encased module 14 or they can be positioned in other parts of the shoe and connected to wires extending from the module. After the module has been assembled and connected to the lights, it can be located and sealed in a cavity in the heel or other convenient location on the shoe.

The switch assembly 16 is comprised of an electrically conducting spring 22 cantilevered over a substrate 24, such as a printed circuit board. The spring 22 is preferably a coil spring. However, leaf or other types of elongated springs can also be used. The spring 22 is mounted on the substrate 24 in a holder 26, e.g., by soldering, so that the spring 22 is fixed at one point 23 and has a free end 25 (FIG. 3). Preferably, the fixed point 23 is at one end of the spring as illustrated, although a mid-point can be chosen and the spring can be mounted to have two free ends so as to provide for a dual-switch assembly. The holder 26 may be electrically conducting and have an extension 28 which serves as one terminal of the switch, which can be connected to the rest of the circuit. Alternately, the holder may be soldered to a wire or circuit trace on the substrate 24 to connect it to a terminal 18. The spring 22 itself can also serve as one terminal.

An electrically conducting contact 30 is positioned on the substrate 24 beneath the spring 22 and between the fixed and free ends 23, 25. At least a portion of the contact 30 projects upwards from the substrate 24 towards the spring 30. The height and position of the contact 30 is chosen so that when the spring is elastically deformed downwards, i.e., as a result of the switch assembly 16 being jolted, the spring makes an electrical connection with the contact and momentarily closes the switch. The contact 30 is preferably a metallic arch which may have an extension 32 which serves as the other terminal of the switch, and which is soldered to a wire or circuit trace on the substrate 24 to connect it to a second terminal 20 and the rest of the module circuitry. Alternatively, the contact 30 may be formed of a bead of solder or a loop of wire projecting from the substrate 24. To protect the switch assembly 16, it may be enclosed in a hollow housing 36 with an end wall 36'.

Further, as illustrated in the preferred embodiments of FIGS. 2 and 3, the substrate 24 has a hole 50 formed therein and positioned beneath the free end of the spring. The hole 50 provides additional room for the free end of the spring to oscillate without increasing the size of the switch.

Figure 4:
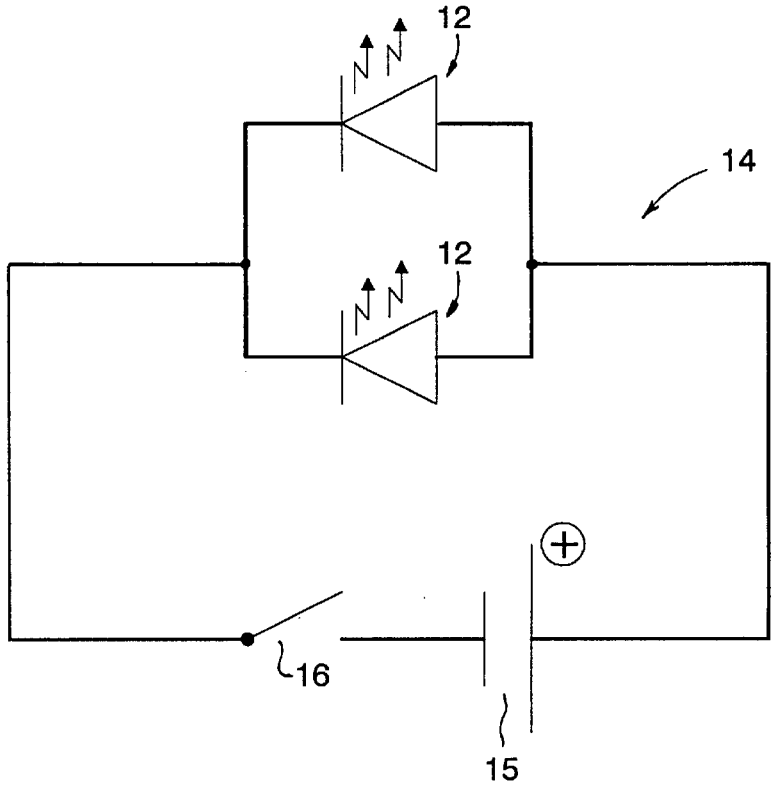
FIG. 4. is a schematic diagram of the circuit arrangement shown in FIGS. 2 and 3.

In the embodiment illustrated in FIGS. 2–4, the switch terminals 18, 20 are connected between the battery 15 and the light sources 12 by wires 38. Light sources 12 may be contained in a housing 40 and made integral with the module 14 or they can be connected to the module by external wires 42 and perhaps mounted on a separate substrate 44. In the preferred embodiment, the battery is mounted on a substrate 46 which can be separate from substrate 24 in the switch 16. In an alternate embodiment, substrate 44 also houses a switching circuit which controls the lights in response to a change in the conductive state of the switch. As shown, when the switch 16 is closed, the power of battery 15 is applied to LEDs 12. Thus, the lights sources 12 are activated during the period the switch 16 is closed. A schematic diagram of the circuit arrangement shown in FIGS. 2 and 3 is illustrated in FIG. 4.

Figure 5:
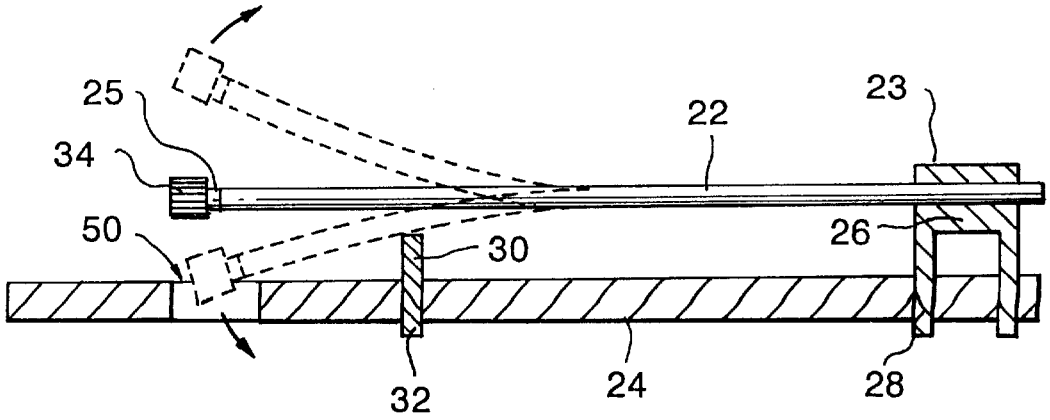
FIG. 5 is a cross sectional view of the improved switching mechanism according to the present invention.

FIG. 5 is a cross-sectional view of the switching assembly 16 according to the present invention. When a downward force is exerted on the coil spring 22, it makes an electrical connection with the contact 30 closing the circuit. Due to inertia, the portion of the spring 22 between the contact 30 and the free end 25 continues to move downward, maintaining the electrical connection between the spring 22 and the contact 30 until the spring 22 has returned nearly to its starting position. As shown, the free end 25 of the spring 22 can extend into hole 50 in substrate 24, providing additional room for the spring to oscillate. To increase the inertia of the spring 22, and thus the force with which the spring will hit the contact and the sensitivity of the switch to motion, the free end 25 of the spring 22 can be weighted by attaching thereto a non-conducting weight 34 such as a plastic cylinder, ball, or rectangle. (See FIGS. 2 and 3). By making the weight non-conducting, its contact with the printed circuit board under it will not short out or otherwise affect any conducting circuit patterns. Thus, there is increased design freedom for the circuit pattern on the substrate 24.

Figure 6:
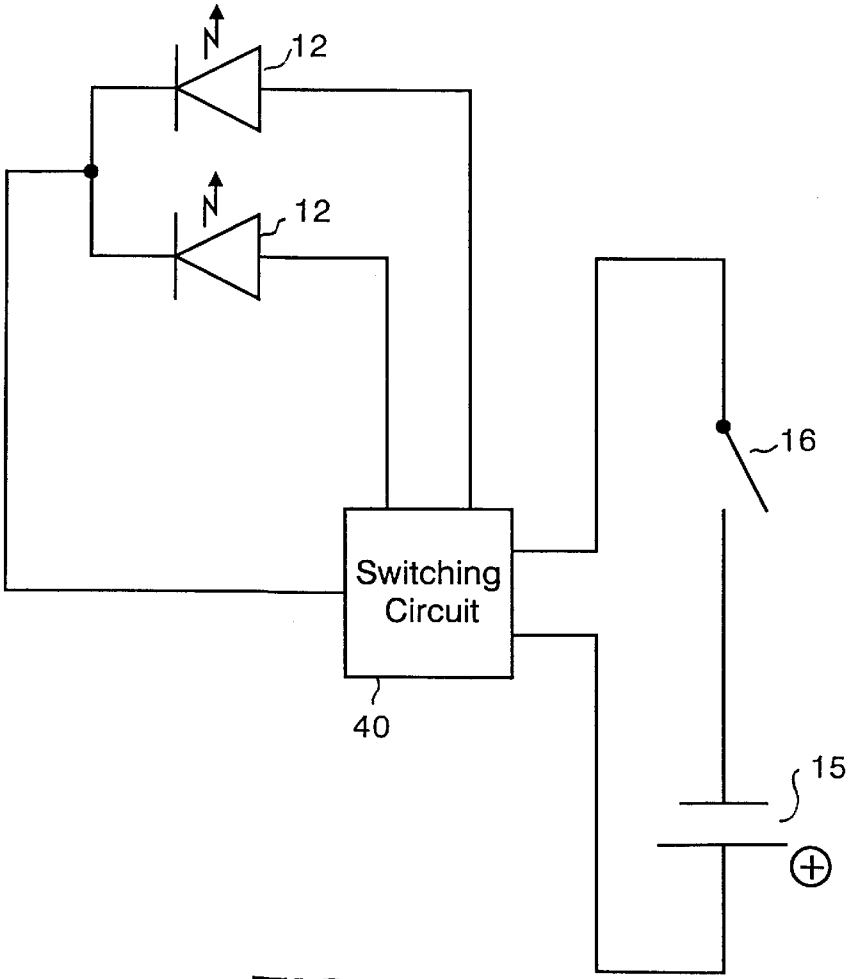

In the embodiment discussed above and with reference to FIG. 4, the switch assembly 16 is used to activate one or more light sources 12 directly. Premature battery exhaustion is prevented because the switch remains closed for only a limited time. To provide for a more exciting light pattern, a switching circuit 40 that energizes the lights for a limited time can be used as shown in FIG. 6. For example, in the alternate embodiment of FIG. 6, the switch assembly 16 is used to activate a switching circuit 40 that may be in the form of an electronic sequencer or flasher which operates to sequence or flash the lights in a predefined or random pattern while the switch remains closed. In this embodiment, the switch assembly 16 and the battery 15 are connected to switching circuit 40 in series so that the power for switching circuit 40 is toggled on and off by the switch. Various switching circuits such as oscillators or random flashers known to those of skill in the art can be used to control the light sources 12. Preferably, the switching circuit 40 is an integrated circuit mounted on substrate 46. However, discrete components and logic circuits can be used as well.

Figure 7:
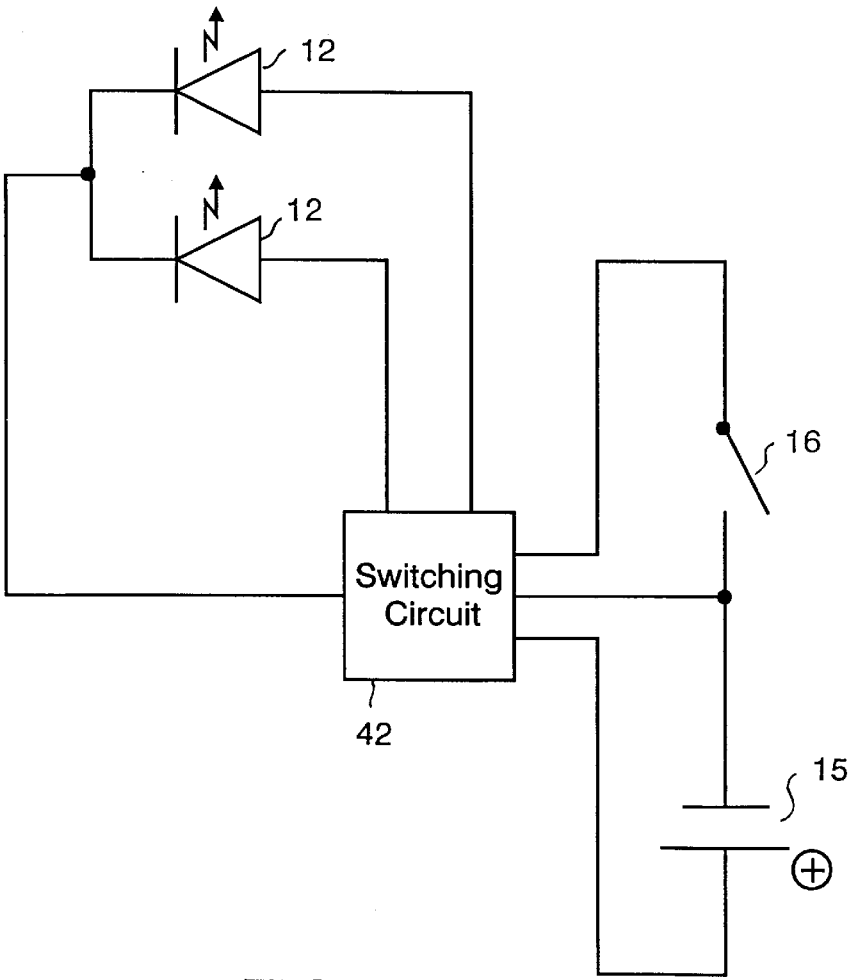
FIGS. 6 and 7 are a schematic diagrams of alternate embodiments of the flashing light system of the present invention incorporating a flasher or other lighting sequence circuit.

Another alternate circuit embodiment is illustrated in FIG. 7. In this embodiment, the switch assembly 16 and the battery 15 are connected to switching circuit 42 in parallel. Because the power supplied to switching circuit 42 is not gated by the switch assembly 16, the powering of the light sources is not limited to the period when switch 16 is closed. Thus, for example, switching circuit 42 may power the light sources 12 when the switch is closed and for an additional period of time after the switch opens. For example, a capacitive delay circuit can be used to provide a sufficient pulse of current to the lights to get a visible image when the switch closes, and a flashing sequence can be activated once the switch opens.

While the invention has been particularly shown and described with reference to preferred embodiments thereof, it will be understood by those skilled in the art that various changes in form and details may be made therein without departing from the spirit and scope of the invention.

I claim:

1. Footwear comprising:

at least one light source located on the footwear so as to be visible and providing electromagnetic radiation illumination when turned on;

a power source capable of providing sufficient power to said at least one light source to cause it to provide the electromagnetic radiation illumination;

a switch having first and second terminals, said switch including:

an electrically conducting spring having a first portion electrically connected to said first terminal and a free end, a non-conducting weight being connected to the free end of the spring and keeping the free end of the spring out of electrical contact with circuit components, and an electrically conducting contact in register with said spring at a point between said first portion and said free end, said contact extending toward said spring but being out of electrical connection with said spring when said spring is not moving, said contact being in contact with and electrically connected to said spring when said spring is elastically deformed towards said contact;

said at least one light source, power source, and switch being connected to supply power from said power source to said at least one light source to cause said at least one light source to illuminate for a period of time in response to a change of the conductive state between said first and second switch terminals.

2. The footwear of claim 1, wherein said spring comprises a hollow coil, a portion of said weight being positioned inside the hollow coil at said free end of the spring.

3. The footwear of claim 1, further comprising:

a printed circuit board for supporting said switch; and a conducting holder mounted on said circuit board and supporting said first portion of said spring, said holder being in electrical contact with said first terminal; and wherein said contact comprises a conducting arch mounted on said circuit board, at least a portion of said arch extends upwards from said circuit board towards said spring, said contact being in electrical contact with said second terminal.

4. The footwear of claim 1, wherein said at least one light source comprises at least one light emitting diode.

5. The footwear of claim 1, further including a circuit connected with said at least one light source, said power source, and said switch to supply power for a plurality of illuminations of said at least one light source after a change in the conductive state between said first and second switch terminals.

6. The footwear of claim 1, further including a circuit connected with said at least one light source, said power source, and said switch to supply power for a single illumination of said at least one light source after a change in the conductive state between said first and second switch terminals.

7. The footwear of claim 6, wherein said circuit supplies power to illuminate said at least one light source only when said spring is in electrical contact with said contact.

8. A light module for use in footwear comprising:

at least one light source providing electromagnetic radiation illumination when turned on;

a power source capable of providing sufficient power to said at least one light source to cause it to provide the electromagnetic radiation illumination;

a switch having first and second terminals, said switch including:

an electrically conducting spring having a first portion electrically connected to said first terminal and a free end, a non-conducting weight being connected to the free end of the spring and keeping the free end of the spring out of electrical contact with circuit components, and an electrically conducting contact in register with said spring at a point between said first portion and said free end, said contact extending toward said spring but being out of electrical connection with said spring when said spring is not moving, said contact being in contact with and electrically connected to said spring when said spring is elastically deformed towards said contact; and a circuit arranged to supply power from said power source to said at least one light source to cause said at least one light source to illuminate for a period of time in response to a change of the conductive state between said first and second switch terminals.

9. The light module of claim 8 wherein said spring comprises a hollow coil, at least a portion of said weight being positioned inside the hollow coil at said free end of the spring.

10. A light module according to claim 8, further comprising:

a substrate for supporting said switch; and a conducting holder mounted on said substrate and supporting said first portion of said spring, said holder being electrically connected to said first terminal; and wherein said contact comprises a conducting arch mounted on said substrate, at least a portion of said contact extending upwards from said substrate towards said spring, said contact being electrically connected to said second terminal.

11. The light module of claim 10, wherein said substrate comprises a printed circuit board.

12. The light module of claim 8, wherein said at least one light source comprises at least one light emitting diode.

13. The light module of claim 8, wherein said circuit supplies power for a plurality of illuminations of said at least one light source after a change in the conductive state between said first and second switch terminals.

14. The light module of claim 8, wherein said circuit supplies power for a single illumination of said at least one light source after a change in the conductive state between said first and second switch terminals.

15. The light module of claim 8, wherein said circuit supplies power to illuminate said at least one light source only when said spring is in electrical contact with said contact.

16. The footwear of claim 3, wherein the printed circuit board for supporting said switch has a hole therein beneath the free end of the spring, the hole providing additional room for the free end of the spring to oscillate without increasing the size of the switch.

17. The footwear of claim 10, wherein the substrate has a hole therein beneath the free end of the spring, the hole providing additional room for the free end of the spring to oscillate without increasing the size of the switch.

18. Footwear comprising:

at least one light source located on the footwear so as to be visible and providing electromagnetic radiation illumination when turned on;

a power source capable of providing sufficient power to said at least one light source to cause it to provide the electromagnetic radiation illumination;

a switch having first and second terminals and being supported by a substrate, said switch including:

an electrically conducting spring having a first portion electrically connected to said first terminal and a free end, and an electrically conducting contact mounted on said substrate in register with said spring at a point between said first portion and said free end and connected to said second terminal, said contact extending toward said spring but being out of electrical connection with said spring when said spring is not moving, said contact being in contact with and electrically connected to said spring when said spring is elastically deformed towards said contact, the substrate having a hole therein beneath the free end of the spring, the hole providing additional room for the free end of the spring to oscillate without increasing the size of the switch;

said at least one light source, power source, and switch being connected to supply power from said power source to said at least one light source to cause said at least one light source to illuminate for a period of time in response to a change of the conductive state between said first and second switch terminals.

19. The footwear of claim 18, further comprising a non-conducting weight connected to the free end of the spring and keeping the free end of the spring out of electrical contact with circuit components.

* * * * *

UNITED STATES PATENT AND TRADEMARK OFFICE

CERTIFICATE OF CORRECTION

PATENT : 6,065,851

DATED : May 23, 2000

INVENTOR(S) : So Kwok Kwong

It is certified that error appears in the above-identified patent and that said Letters Patent is hereby corrected as shown below:

Title page, item [75] Inventor, change "Kwok Kwong So" to -- So Kwok Kwong --.

Signed and Sealed this

Twentieth Day of March, 2001

Nicholas P. Godici

*Attest:*

NICHOLAS P. GODICI

*Attesting Officer*

*Acting Director of the United States Patent and Trademark Office*